US005484258A

United States Patent [19]

Isburgh et al.

[11] Patent Number: 5,484,258

[45] Date of Patent: Jan. 16, 1996

[54] TURBINE AIRFOIL WITH CONVECTIVELY COOLED DOUBLE SHELL OUTER WALL

[75] Inventors: Anne M. Isburgh, Loveland; Ching-Pang Lee, Cincinnati, both of Ohio

[73] Assignee: General Electric Company, Cincinnati, Ohio

[21] Appl. No.: 203,246

[22] Filed: Mar. 1, 1994

[51] Int. Cl.[6] ..... F01D 5/18

[52] U.S. Cl. ..... 415/115; 416/97 R

[58] Field of Search ..... 416/97 R, 96 A, 416/233; 415/115

[56] References Cited

U.S. PATENT DOCUMENTS

| | | | |
|---|---|---|---|
| 3,540,810 | 11/1970 | Kercher . | |
| 3,726,604 | 4/1973 | Helms et al. . | |
| 3,806,276 | 4/1974 | Aspinwall . | |
| 3,902,820 | 9/1975 | Amos . | |
| 3,930,748 | 10/1976 | Redman et al. . | |
| 4,064,300 | 12/1977 | Bhangu . | |
| 4,086,021 | 4/1978 | Stenfors . | |
| 4,105,364 | 8/1978 | Dodd . | |
| 4,118,146 | 10/1978 | Dierberger . | |
| 4,183,716 | 1/1980 | Takahara et al. . | |
| 4,236,870 | 12/1980 | Hucul, Jr. et al. . | |
| 4,270,883 | 6/1981 | Corrigan . | |
| 4,403,917 | 9/1983 | Laffitte et al. . | |
| 4,515,523 | 5/1985 | North et al. . | |
| 4,529,357 | 7/1985 | Holland | 416/97 R |
| 4,695,247 | 9/1987 | Enzaki et al. . | |
| 4,697,985 | 10/1987 | Suzuki . | |
| 4,790,721 | 12/1988 | Morris et al. . | |
| 4,946,346 | 8/1990 | Ito . | |
| 5,030,060 | 7/1991 | Liang . | |
| 5,073,086 | 12/1991 | Cooper . | |
| 5,120,192 | 6/1992 | Ohtomo et al. | 416/96 A |
| 5,215,431 | 6/1993 | Derrien | 416/97 R |
| 5,328,331 | 7/1994 | Bunker et al. | 416/97 R |

FOREIGN PATENT DOCUMENTS

| | | | |
|---|---|---|---|
| 0153903 | 9/1982 | Japan | 416/97 R |
| 0005404 | 1/1983 | Japan | 416/97 R |
| 0149503 | 7/1986 | Japan | 416/97 R |
| 0243324 | 10/1969 | U.S.S.R. | 416/97 R |

*Primary Examiner*—Edward K. Look
*Assistant Examiner*—Mark Sgantzos
*Attorney, Agent, or Firm*—Andrew C. Hess; Patrick R. Scanlon

[57] ABSTRACT

A coolable airfoil for use in gas turbine engine component such as a turbine blade or vane is provided with a one-piece integrally formed double shell outer wall surrounding at least one radially extending cavity. The inner and the outer shells are integrally formed of the same material together with tying elements in the form of continuous ribs which space apart the shells, mechanically and thermally tie the shells together, and form convective cooling passages therebetween.

12 Claims, 8 Drawing Sheets

TURBINE AIRFOIL WITH CONVECTIVELY COOLED DOUBLE SHELL OUTER WALL

BACKGROUND OF THE INVENTION

1. Field of the Invention

This invention relates to cooling of turbine airfoils and more particularly to hollow turbine vanes having double shell airfoil walls.

2. Description of Related Art

It is well known to cool parts using heat transfer across walls having hot and cold surfaces by flowing a cooling fluid in contact with the cold surface to remove the heat transferred across from the hot surface. Among the various cooling techniques presently used are convection, impingement and film cooling as well as radiation. These cooling techniques have been used to cool gas turbine engine hot section components such as turbine vanes and blades. A great many high pressure turbine (HPT) vanes, and particularly the high pressure turbine inlet guide vane, also known as the combustor nozzle guide vane, utilize some form of a cooled hollow airfoil. An airfoil typically has a hollow body section which includes a leading edge having a leading edge wall followed by a pressure side wall and a suction side wall which form a substantial part of the outer wall which includes the hot wetted surface on the outside of the walls. The pressure and suction side walls typically converge to form a trailing edge.

Typically, a vane having a hollow airfoil is cooled using two main cavities, one with coolant air fed from an inboard radial location and the other with coolant air fed from an outboard location. These cavities contain impingement inserts which serve to receive cooling air and direct the coolant in impingement jet arrays against the outer wall of the airfoil's leading edge and pressure and suction side walls to transfer energy from the walls to the fluid, thereby, cooling the wall. These inserts are positioned by inward protrusions from the outer wall of the airfoil. These protrusions or positioning dimples are not connected to the inserts and provide the barest of contact between the insert and the airfoil wall (no intimate material contact at all). The high pressure of the cooling air in the cavity or insert is greater than that of the air on the outside of the airfoil causing a great deal of stress across the airfoil wall. One of the most frequent distress and life limiting mechanisms in conventional and particularly single wall vane airfoils is suction side panel blowout. This is a creep rupture phenomenon caused by stresses due to bending and temperature. Therefore an airfoil design is needed that will reduce these stresses and prolong the creep rupture life of the airfoil and turbine vane or blade.

Disclosed in U.S. Pat. No. 3,806,276 entitled "Cooled Turbine Blade", by Aspinwall, is a turbine blade having an insert or a liner made of a high conductivity metal such as cuprous nickel and which is bonded to a point on the radially extending ribs along the outer wall of the blade. The liner, because it is made of a high conductivity metal such as cuprous nickel has low strength and must be considered as dead load (non load/stress carrying). Therefore, it adds no significant stiffness to the airfoil and is not very capable of resisting bending moments due to the pressure differential across the airfoil outer wall. Another drawback is the bond points because they are inherently weaker than the surrounding material and therefore subject to failure under loads due to pressure differential induced bending moments and centrifugal forces in the case of rotating blades. Furthermore, since the insert is dead load, the outer wall of the blade will have to be thickened to carry the additional mass due to the centrifugal load which a turbine blade is subjected to. This will effectively increase the temperature differential AT across the outer wall thereby raising the peak surface temp and the thermal stresses.

Such vanes also utilize other common design features for cooling such as film cooling and a trailing edge slot and have typically been manufactured from materials with thermal conductivities in the range of 10 to 15 BTU/hr/ft/° F. A primary goal of turbine design is improved efficiency, and a key role in this is the reduction of component cooling flows. With the development of intermetallic materials, thermal conductivities on the order of 40 BTU/hr/ft/° F. or even greater may be realized. Fabrication of intermetallic components by means other than casting or welding allows the design of more complex components with new features.

Turbine vane cooling requires a great deal of cooling fluid flow which typically requires the use of power and is therefore generally looked upon as a fuel efficiency and power penalty in the gas turbine industry. Regenerative combustion using the cooling air outflow from the vane to recapture energy in the form of heat in the outflow is a well known means of improving engine efficiency. Heat is transferred through the turbine vane walls back into the combustor by directing at least a portion of cooling air outflow into the inlet of the combustion chamber to be mixed with fuel for combustion. Regenerative cooling that uses the cooling air outflow from the turbine vane to cool other parts of the engine, such as the combustor and combustor liner, is another method known to improve overall engine efficiency. The present invention provides improved turbine vane cooling and engine efficiency and is particularly useful in gas turbine engines with regenerative combustion and cooling means.

SUMMARY OF THE INVENTION

According to the present invention a radially extending airfoil having a hollow body section including a leading edge section and a pressure side and a suction side is provided with a one-piece integrally formed double shell hollow outer wall surrounding at least one radially extending cavity. The inner and the outer shells are integrally formed as a one-piece article of the same material together with radially extending continuous tying ribs which space apart the shells. The ribs form radially extending convective cooling passages in the double shell hollow outer wall between the shells and the inner shell is devoid of any apertures along the convective cooling passages. The integrally formed tying ribs mechanically and thermally tie the shells together. A means is provided for directing cooling air through the double shell hollow outer wall between the convective cooling passages from a compressor of the engine and through a platform of the blade.

One embodiment of the present invention provides film cooling means for the outer shell and the use of trailing edge cooling means such as cooling slots. Another embodiment of the present invention provides a regenerative combustion means for directing cooling air outflow from the turbine vane to the inlet of the combustion chamber for mixing with the fuel and air mixture in a combustor. One other embodiment of the present invention provides a regenerative cooling means for directing cooling air outflow from the turbine vane to the combustor for cooling a combustor and in a more particular embodiment for cooling a combustor liner. Additional features and embodiments contemplated by the present invention include inner and outer shells of equal and unequal thicknesses.

ADVANTAGES

The present invention provides a gas turbine engine coolable airfoil with a double shell outer wall which is operable to be convectively cooled and able to more effectively utilize essentially twice as much surface area for heat transfer internally as compared to a single shell wall. The use of two shells allows the inner shell to be maintained at a lower temperature than the outer shell, while the outer shell is maintained at a similar temperature level to that of the single shell design. The resulting double shell wall bulk temperature is much lower than that of a single shell wall. This results in a significant reduction in coolant requirements and thus improved turbine efficiency. The one-piece integrally formed and connected double shell wall design more efficiently resists bending loads due to the pressure differential across the wall particularly at elevated temperatures. This leads to increased creep rupture life for airfoil turbine walls. The present invention can be used to save weight, or, alternately, increase creep/rupture margin. The invention also reduces the amount of coolant flow required which improves engine fuel efficiency. Additional tie elements in the form of ribs or tie rods disposed across the cavity attaching the suction side of the wall to the pressure side of the wall may be utilized to limit the bending stresses to an even greater degree. The improved cooling efficiency also enhances the use of regenerative combustion means to recapture heat from the cooling air outflow from the turbine vane and flow it to the combustion chamber where it can be mixed with the main flow thereby returning its heat energy to do useful work in the engine and improve overall engine efficiency. The engine efficiency is further enhanced by using cooling air outflow in the regenerative combustion process to first cool a part of the combustor such as the combustor liner before dumping it into the combustion chamber and thereby reduce the amount of compressor cooling air needed to cool the liner. This aspect of the present invention also reduces the amount of coolant flow required which improves engine fuel efficiency.

The foregoing, and other features and advantages of the present invention, will become more apparent in the light of the following description and accompanying drawings.

BRIEF DESCRIPTION OF THE DRAWINGS

The foregoing aspects and other features of the invention are explained in the following description, taken in connection with the accompanying drawings where.

DETAILED DESCRIPTION OF THE INVENTION

Figure 1:
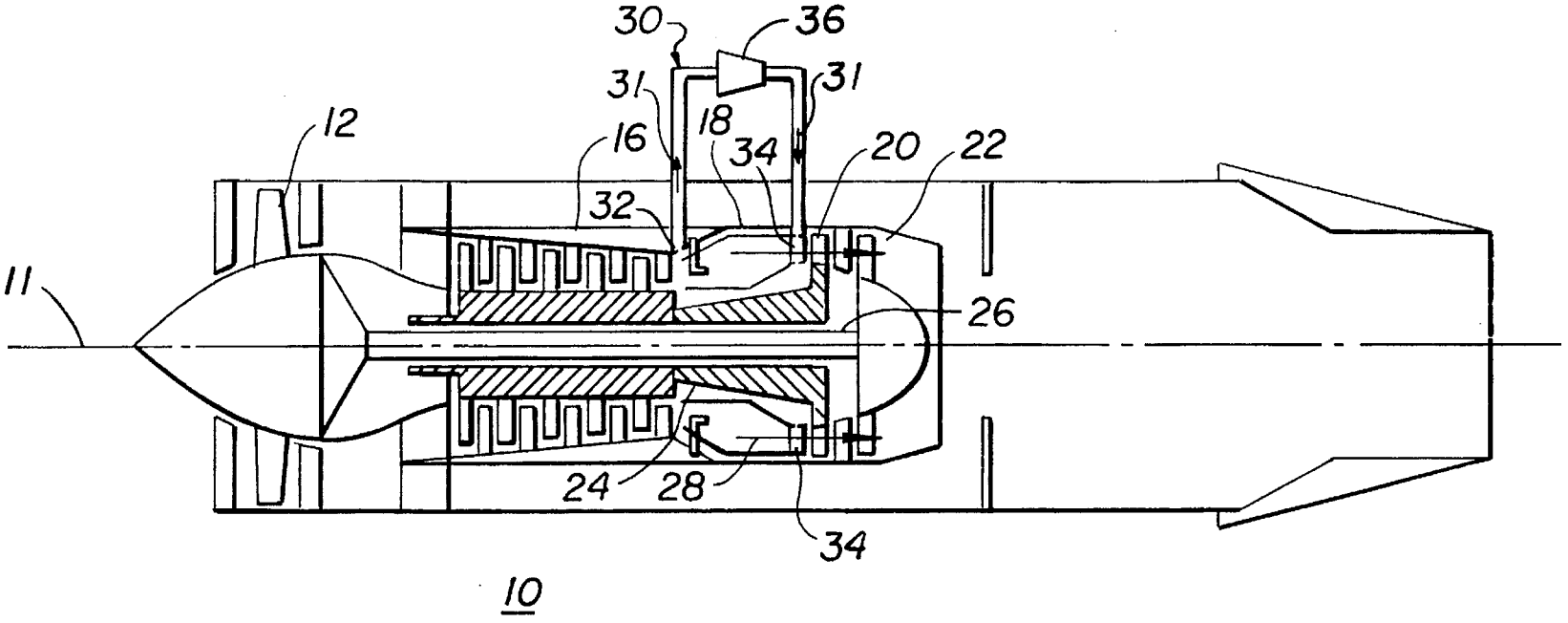
FIG. 1 is a cross-sectional view of a gas turbine engine having turbine inlet guide vanes with convectively coolable airfoils having double shell walls in accordance with the present invention.

Illustrated in FIG. 1 is a gas turbine engine 10 circumferentially disposed about an engine centerline 11 and having, in serial flow relationship, a fan section indicated by a fan section 12, a high pressure compressor 16, a combustion section 18, a high pressure turbine 20, and a low pressure turbine 22. The combustion section 18, high pressure turbine 20, and low pressure turbine 22 are often referred to as the hot section of the engine 10. A high pressure rotor shaft 24 connects, in driving relationship, the high pressure turbine 20 to the high pressure compressor 16 and a low pressure rotor shaft 26 drivingly connects the low pressure turbine 22 to the fan section 12. Fuel is burned in the combustion section 18 producing a very hot gas flow 28 which is directed through the high pressure and low pressure turbines 20 and 22 respectively to power the engine 10. A cooling air supply means 30 provides cooling air 31 from a compressor stage of the engine 10 such as a bleed means at compressor discharge 32 to a downstream element of the hot section such as a turbine inlet guide vane 34. The pressure of the cooling air taken from the compressor discharge 32 may be boosted by an optional supplemental compressor 36 if desired.

Figure 2:
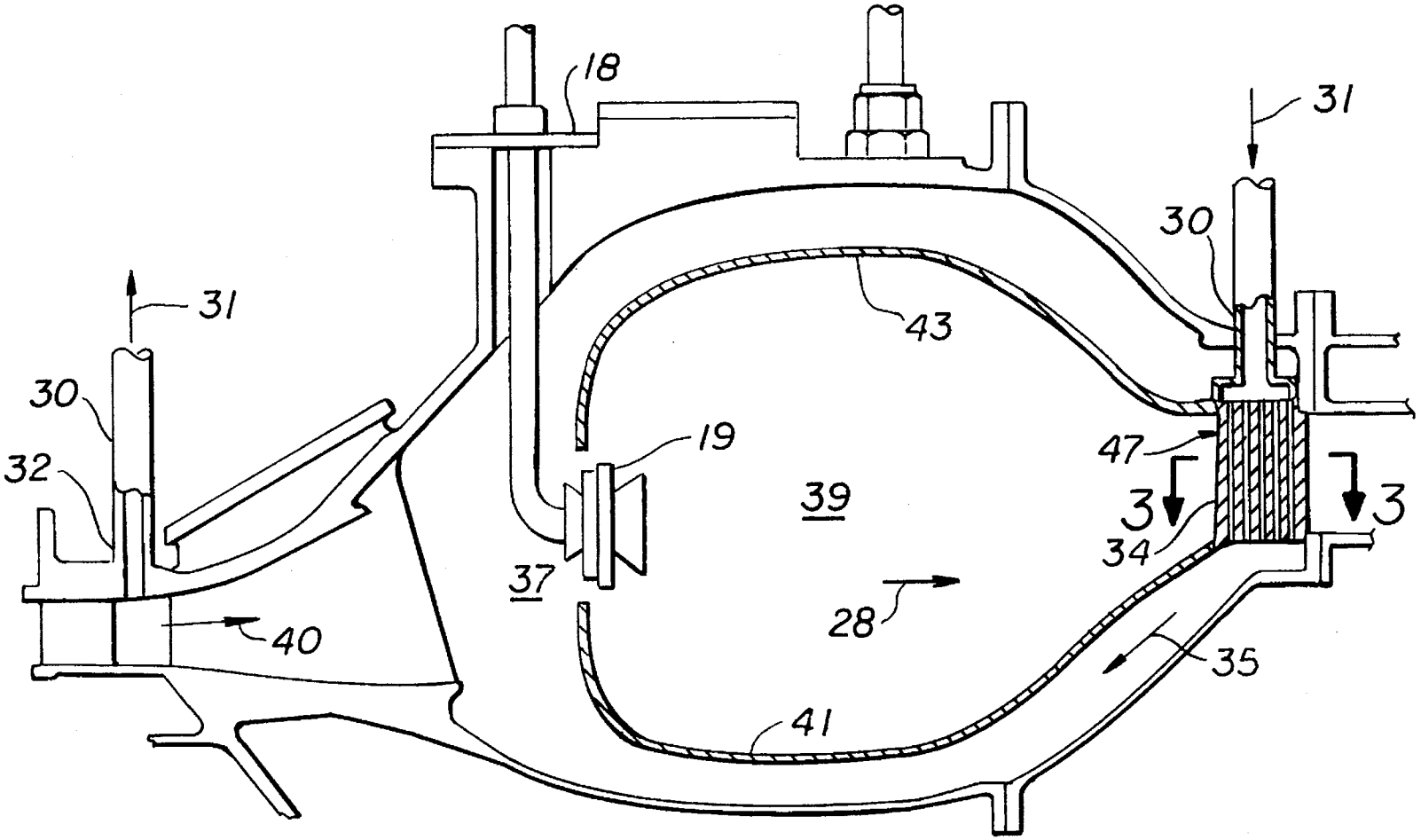
FIG. 2 is an enlarged cross-sectional view of a portion of a hot section with a regenerative combustor in the engine illustrated in FIG. 1.

Illustrated in FIG. 2 is an example of a portion of a hot section of the engine 10 which is constructed to regeneratively use the cooling air 31 supplied to the vane 34 to recapture energy in the form of heat in cooling air outflow 35. The cooling air outflow 35 is directed into the inlet 37 of a combustion chamber 39 between inner and outer combustor liners, 41 and 43 respectively, in the combustion section 18 where it is mixed with fuel from fuel injectors 19 and compressor discharge airflow 40 for combustion. Thus heat energy transferred from the hot gas flow 28 through the vane 34 is recaptured in the form of heat in the outflow 35 and directed back into the combustion chamber 39 to be used for doing work in the turbine section.

Figure 2A:
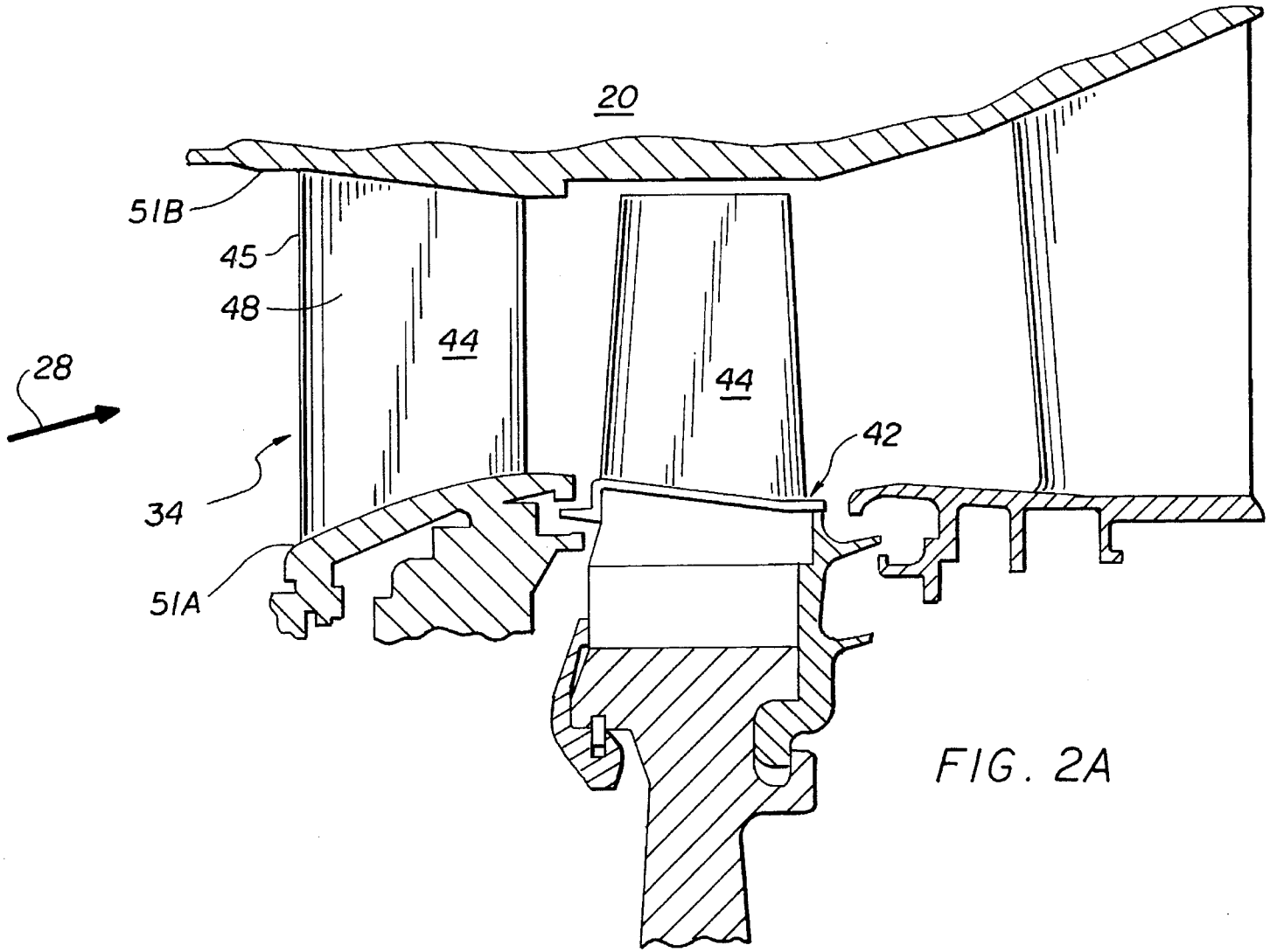
FIG. 2A is an elevated view of a portion of a hot section with coolable airfoils in a turbine of the engine illustrated in FIG. 1.

FIG. 2A more particularly illustrates the inlet guide vane 34 having an airfoil 44 constructed in accordance with the present invention. The airfoil 44 construction of the present invention may be used for any cooled airfoil such as in a turbine blade 42. The airfoil 44 has an outer wall 46 with a hot wetted surface 48 which is exposed to the hot gas flow 28. Vanes 34, and in many cases turbine blades 42, are often cooled by air routed from the fan or one or more stages of the compressors. Air is typically directed through an inner platform 51A or an outer platform 51B of the vane 34 or, for a blade, by a conventional TOBI system (tangential onboard injection). The present invention provides an internal cooling scheme for airfoils 44.

Figure 3:
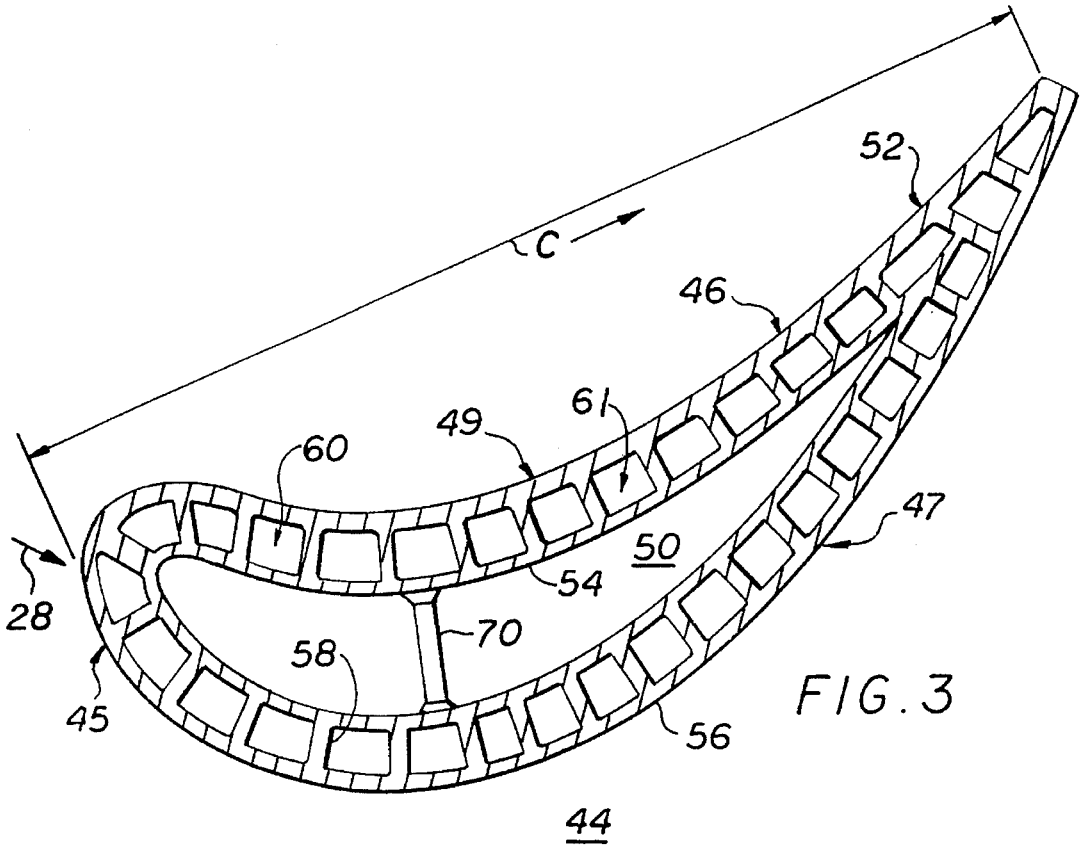
FIG. 3 is a cross-sectional view of a convectively cooled turbine vane airfoil taken through 3—3 in FIG. 2 in accordance with a first exemplary embodiment of the present invention.
Figure 4:
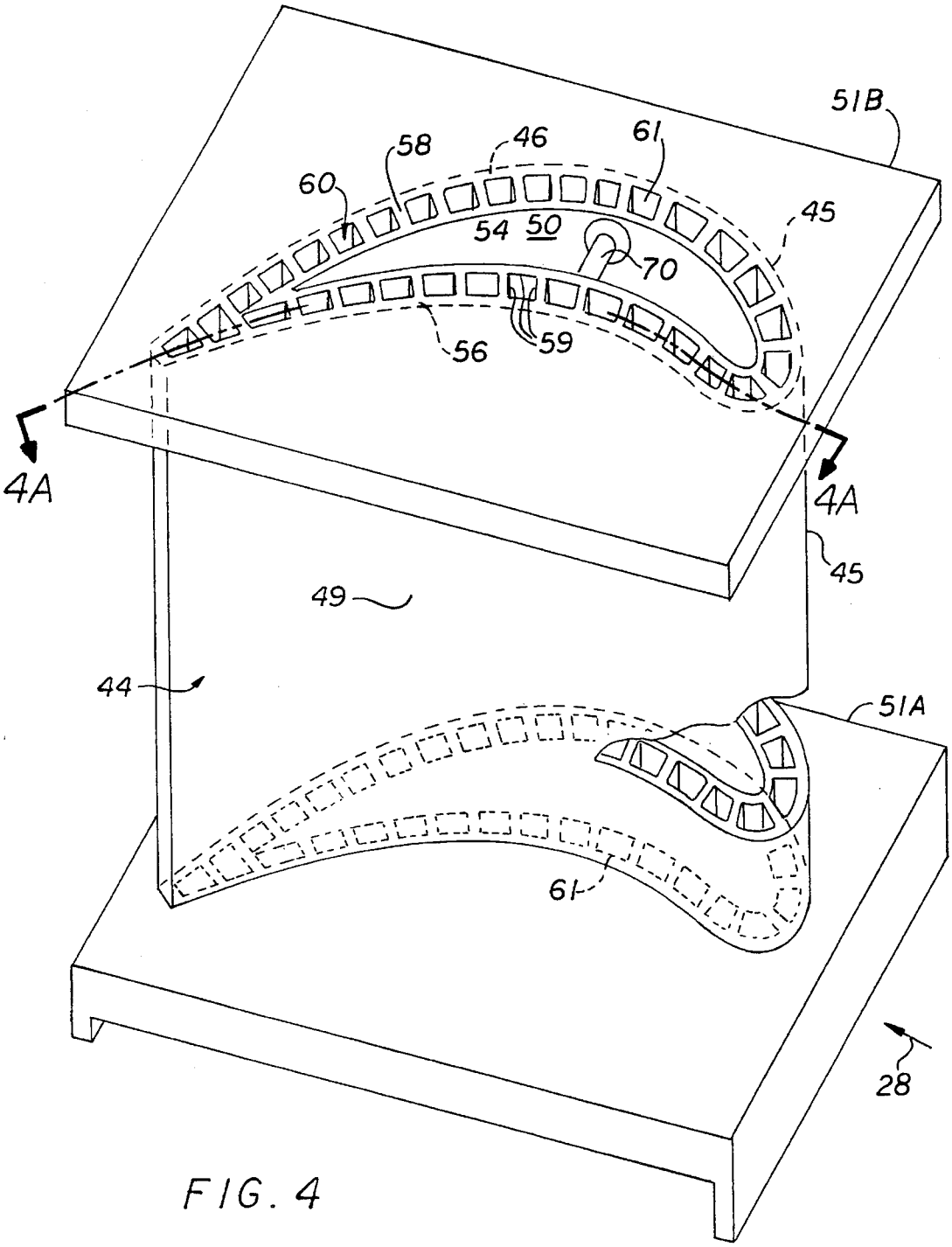
FIG. 4 is an enlarged partially cut-away perspective view illustrating a first turbine inlet guide vane having a cooled airfoil in accordance with the first exemplary embodiment of the present invention illustrated in FIG. 3.

Illustrated in FIGS. 3 and 4 is the airfoil 44 which includes a leading edge section 45, a suction side 47, and a pressure side 49, and terminates in a trailing edge 52. The present invention provides the airfoil 44 with an outer wall 46 which surrounds at least one radially extending cavity 50 which as an option is operably constructed to receive cooling air 31 through at least one of the inner and outer platforms 51A and 51B. The double shell outer wall 46 extends generally in the chordwise direction C from the leading edge section 45 through and between the suction side 47 and the pressure side 49. According to the present invention the outer wall 46 has a one-piece integrally formed double shell construction including an inner shell 54 spaced apart from an outer shell 56 with mechanically and thermally tying elements in the form of continuous tying ribs 58 which are integrally formed with and disposed between the inner and outer shells. The ribs 58 space apart the inner and outer shells 54 and 56 respectively such that the shells are essentially parallel to each other.

The exemplary embodiment illustrated in FIGS. 3 and 4 provides a double shell construction of the outer wall 46 which only extends chordwise C through a portion of the airfoil 44 that does not generally include the trailing edge 52. This is not to be construed as a limitation of the invention and an inner shell 54 could be constructed so as to extend into the trailing edge as well.

The double shell design, particularly when it is constructed of a preferably high thermal conductivity material for example an intermetallic such as a nickel aluminide, permits a substantial amount of the external heat load to be transferred by conduction from the outer shell 56 to the inner shell 54 through the connecting ribs 58. A convective cooling means for cooling the outer shell 56 is provided in the form of a plurality of convective cooling passages 60 having openings 61 which serve as inlets or outlets, depending on the direction of the cooling airflow through the cooling passages. The convective cooling passages 60 are formed between the ribs 58 and portions 59 of the inner and outer shells 54 and 56 respectively. The portions 59 along the inner shell 56 are essentially devoid of apertures and thus essentially no cooling air is permitted to flow in or out of the convective cooling passages 60 except through the openings 61. The cooling air is directed to flow in or out of the convective cooling passages 60 through the openings 61 which are preferably disposed through the inner and outer platforms 51A and 51B respectively. Heat is removed from the inner and outer shells 54 and 56 respectively by convection through the cooling passages 60. The ribs 58 also serve to reduce the temperature gradient from the inner shell 54 to the outer shell 56 which helps reduce thermal stresses.

The following nomenclature is used below. A subscript 2 indicates characteristics and parameters associated with the inner shell 54 and a subscript 1 indicates characteristics and parameters associated with the outer shell 56 of the present invention. Characteristics and parameters not subscripted are associated with a reference single shell outer wall of the prior art. A conventional airfoil provided with an insert and convective cooling paths between the insert and a single shell outer wall transmits an external heat load to the outer wetted surface through the outer wall and into the fluid. The convective heat transfer coefficient is h, and the inner surface-to-fluid temperature potential is $\Delta T$. For an internal surface area of A, the heat flux to the fluid is $Q=hA\Delta T$. In the present invention, the inner surface of the outer shell still experiences a convective heat transfer level characterized by a convective heat transfer coefficient h, but at a slightly reduced temperature potential $\Delta T_1$. The outer surface of the inner shell experiences a heat transfer coefficient $h_2$, which may be of a magnitude nearly as great as h depending upon geometric and fluid dynamic parameters. Due to conduction of energy through the pedestals, the temperature potential $\Delta T_2$ from the inner shell to the fluid is still significant. The sum of these heat fluxes, $$Q=Q_1+Q_2=hA_1\Delta T_1+h_2A_2\Delta T_2$$

is greater than that of the single shell design, resulting in an adjusted external heat load.

Figure 6:
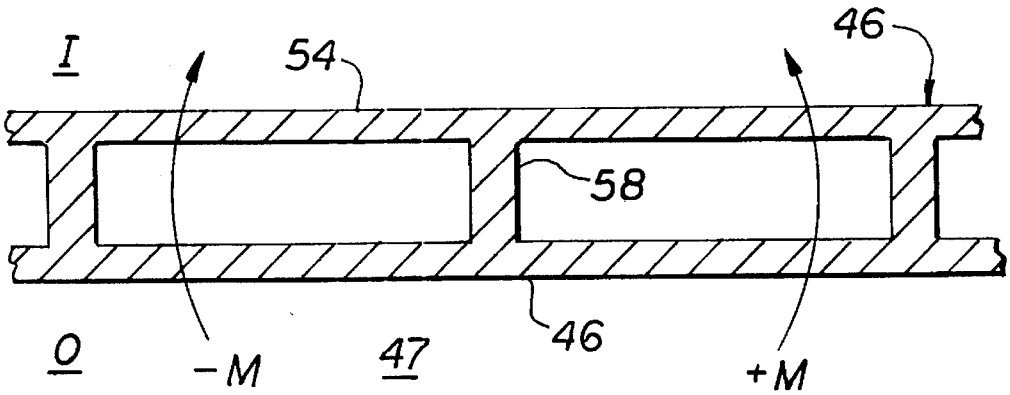
FIG. 6 is an enlarged cross-sectional view of a portion of the turbine vane airfoil in FIG. 3.

Mechanically, the double shell one-piece airfoil design is a more efficient design. Referring to FIG. 6, for constant volume of material, the double shell has a higher moment of inertia in the bending plane shown. An aft portion of the outer wall 46 in the suction side 47 of vane airfoil is subjected to a high temperature and significant pressure loading from the inside I to outside O of the vane. This causes bending moments ±M which is resisted by the unique structure of the double shell outer wall 46 because it has a higher moment of inertia in the bending plane. One of the most frequent distress and life limiting mechanisms in the single wall vane is suction side panel blowout, which is a creep rupture phenomenon caused by stresses due to bending and temperature. The higher moments of inertia with the one-piece integrally formed double shell design having the inner and outer shells, 54 and 56 respectively, mechanically tied together by the ribs 58 will reduce the mechanical stress, and therefore, prolong the creep rupture life.

Figure 3A:
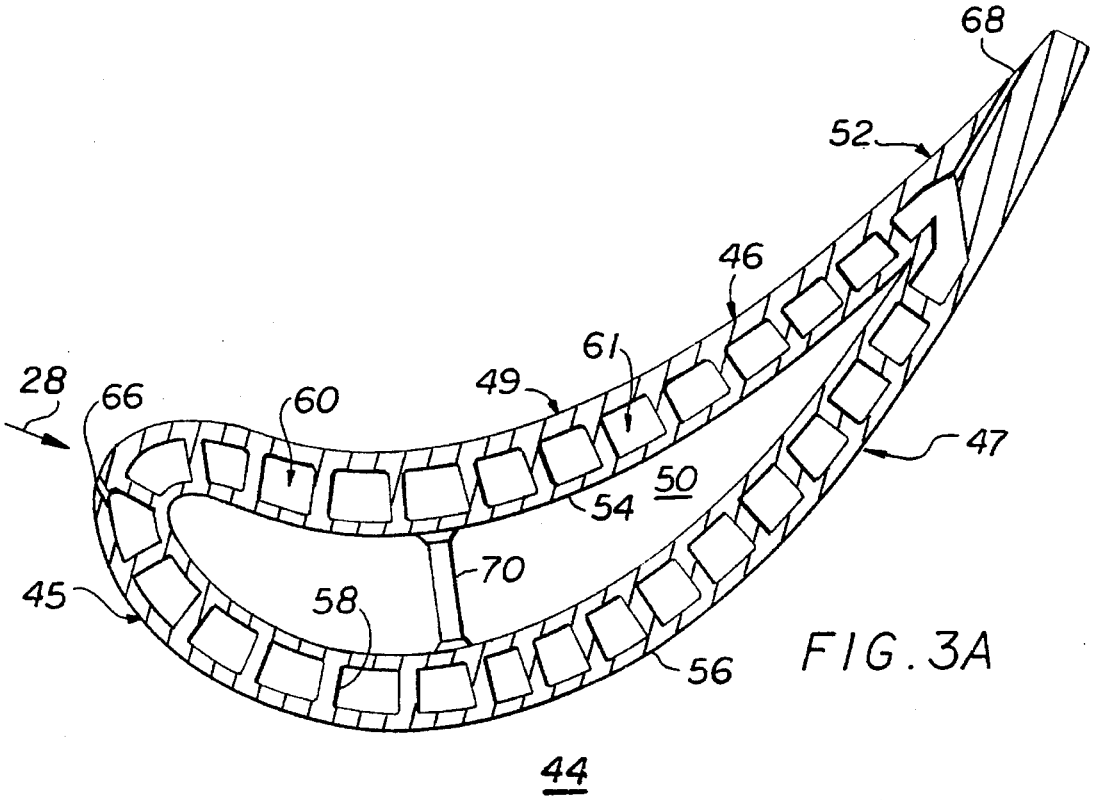
FIG. 3A is a cross-sectional view of a convectively cooled turbine vane airfoil taken through 3—3 in FIG. 2 in accordance with a second exemplary embodiment of the present invention.

FIG. 3A illustrates additional features of alternate embodiments of the present invention such as a leading edge cooling means for the leading edge of the airfoil along the outer shell 56 exemplified in the FIG. by cooling holes 66. Another such feature is a trailing edge cooling means shown as cooling slot 68. Cooling for both of these optional features as well as others such as film cooling apertures along the hot surface of the outer shell may be supplied through apertures through the outer shell from a serpentine convective flowpath shown in FIG. 5A or from the radially extending cavity 50. Alternative embodiments contemplated by the present invention also include providing inner and outer shells of equal and unequal thicknesses in order to balance mechanical and thermal stress requirements.

Figure 5:
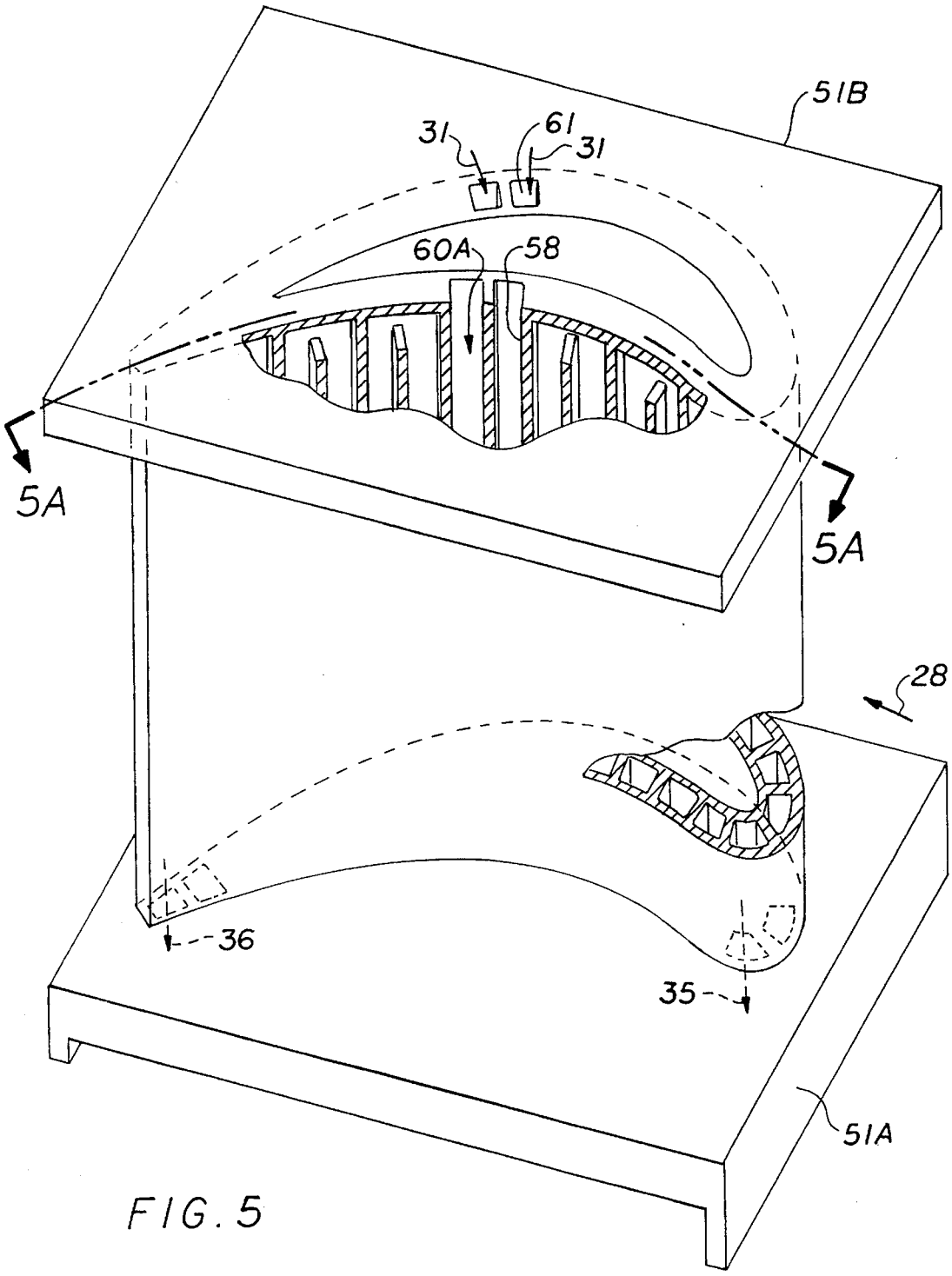
FIG. 5 is an enlarged partially cut-away perspective view illustrating a second turbine inlet guide vane having a cooled airfoil in accordance with the second exemplary embodiment of the present invention illustrated in FIG. 3A.

Another optional feature illustrated in the exemplary embodiment of FIGS. 3–5 is a plurality of mechanical tie members 70, illustrated as, but not limited to, rods, which are utilized to mechanically attach the outer wall 46 along the suction side 47 of the airfoil 44 to the outer wall along the pressure side 49 of the airfoil to further limit the bending stresses in the outer wall. Another drawback to the prior art is that the use of such tie members across the cavity 50 is not an effective means of controlling stresses in the single wall design of the prior art because the inserts are not mechanically well connected to the vane walls. Alternatively the use of such tie members would require multiple inserts on either side of such tie members that may not otherwise be necessary or feasible.

Figure 4A:
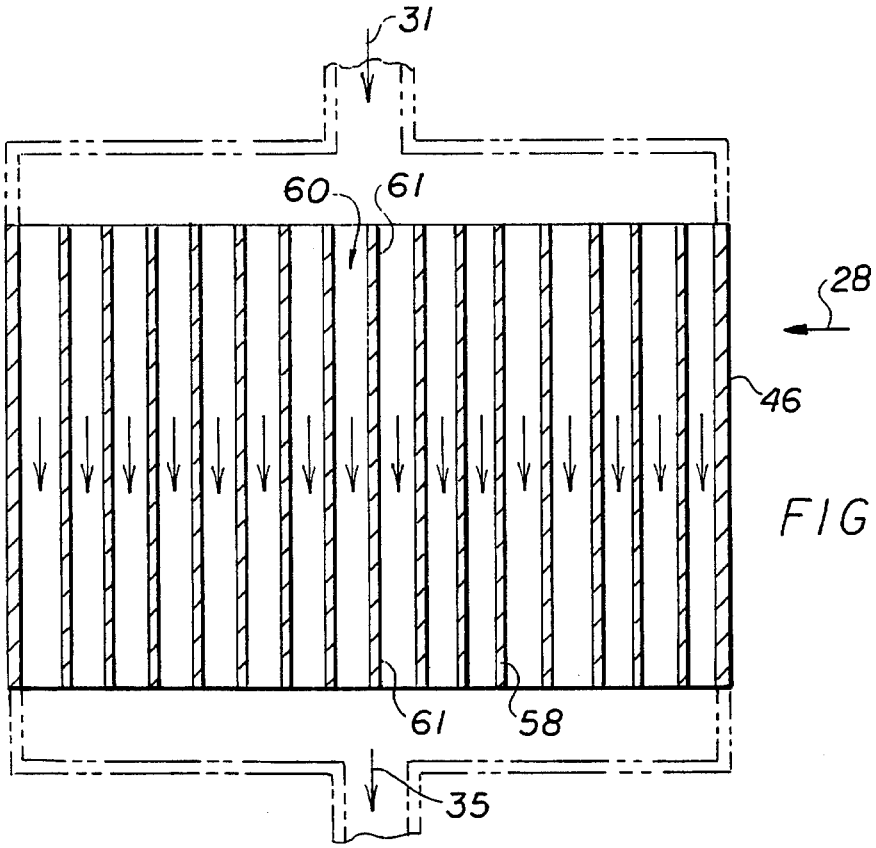
FIG. 4A is a cross-sectional view of the first turbine inlet guide vane taken through 4A—4A in FIG. 4 in accordance with the first exemplary embodiment of the present invention.
Figure 5A:
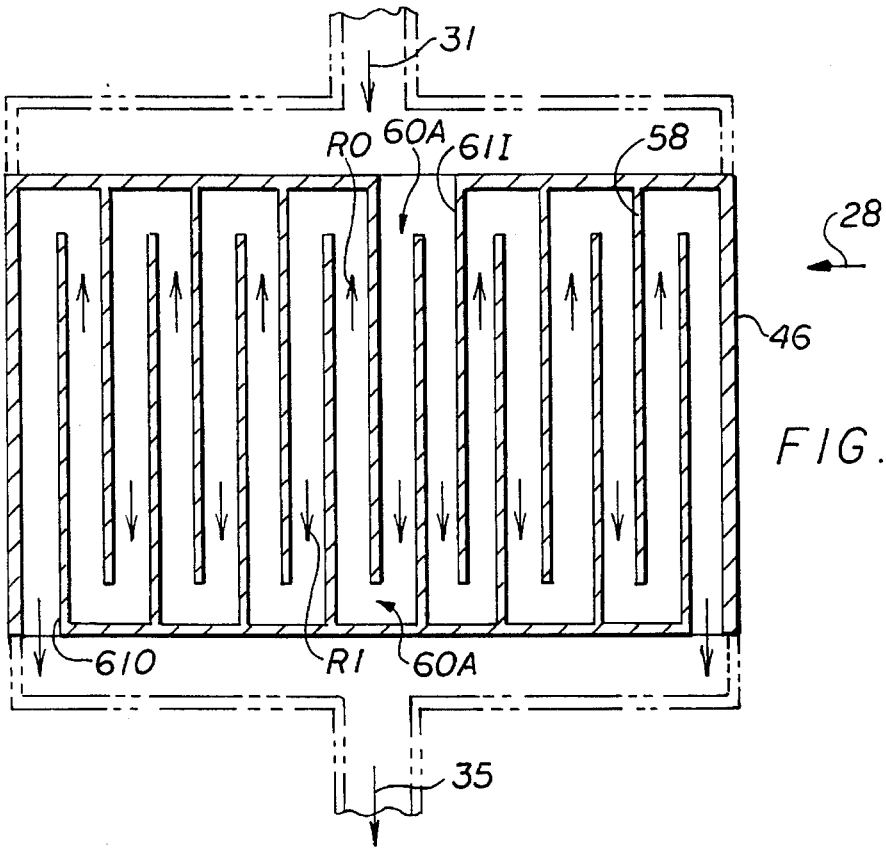
FIG. 5A is a cross-sectional view of the second turbine inlet guide vane taken through 5A—5A in FIG. 5 in accordance with the second exemplary embodiment of the present invention.

FIG. 4A illustrates, in more detail, the plurality of convective cooling passages 60 having openings 61 as being straight wherein the cooling air 31 makes a single radial pass through the cooling passages of the outer wall 46. FIGS. 5 and 5A illustrate another embodiment that uses a serpentine shaped convective cooling passages 60A having openings 61 wherein 61I is illustrated as inlets and 610 as outlets. The cooling air 31 is routed around within the airfoil 44 so that it travels radially inward RI and radially outward RO as opposed to only inward or outward as in the embodiment illustrated in the FIG. 4A.

While the preferred and an alternate embodiment of the present invention has been described fully in order to explain its principles, it is understood that various modifications or alterations may be made to the preferred embodiment without departing from the scope of the invention as set forth in the appended claims.

We claim:

1. A coolable airfoil for use and exposure in a hot gas flow of a gas turbine engine, said coolable airfoil comprising:

a hollow body section including a chordwise extending leading edge suction (operably) connected to a pressure side and a suction side of the airfoil, a one-piece integrally formed double shell outer wall surrounding at least one radially extending cavity and extending chordwise through said leading edge section, pressure side, and suction side, said outer wall comprising an inner shell and an outer shell integrally formed with tying ribs therebetween of the same material as said shells, said tying ribs operably constructed to space apart said shells such that said shells are essentially parallel and mechanically and thermally tie said shells together, and said ribs forming radially extending convective cooling passages between said shells wherein said inner shell is devoid of any apertures along said convective cooling passages.

2. A coolable airfoil as claimed in claim 1 wherein said cooling passages are generally straight and further comprise a first plurality of openings at radially inner ends of each of said passages and a second plurality of openings at radially outer ends of each of said passages wherein inlets to said passages comprise one of said first and second pluralities of openings and outlets to said passages comprise another of said first and second pluralities of openings.

3. A coolable airfoil as claimed in claim 1 wherein at least one of said cooling passages further comprises:

an inlet and an outlet to said passage, a serpentine cooling path between said inlet and said outlet, said serpentine cooling path including a means to direct cooling air in radially inward and outward directions between said inlet and said outlet.

4. A coolable airfoil as claimed in claim 1 further comprising tie elements disposed across said cavity between spaced apart portions of said inner shell of said outer wall along said pressure side and said suction side.

5. A coolable airfoil as claimed in claim 4 wherein said inner shell and an outer shell are of unequal thicknesses.

6. A vane comprising:

an inner platform, an outer platform radially spaced apart from said inner platform, a coolable airfoil radially extending between said platforms and comprising:

a hollow body section including a chordwise extending leading edge section (operably) connected to a pressure side and a suction side of the airfoil, a one-piece integrally formed double shell outer wall surrounding at least one radially extending cavity and extending chordwise through said leading edge section, pressure side, and suction side, said outer wall comprising an inner shell and an outer shell integrally formed with tying ribs therebetween of the same material as said shells, said tying ribs operably constructed to space apart said shells such that said shells are essentially parallel and mechanically and thermally tie said shells together, and said ribs forming radially extending convective cooling passages between said shells wherein said inner shell is devoid of any apertures along said convective cooling passages.

7. A vane as claimed in claims 6 further comprising at least one inlet to at least one of said passages wherein said inlet comprises a first opening through a first one of said platforms.

8. A vane as claimed in claim 7 further comprising at least one outlet to at least one of said passages wherein said outlet comprises a second opening through a second one of said platforms.

9. A vane as claimed in claim 6 wherein said cooling passages are generally straight and further comprise a first plurality of openings through a first one of said platforms at radially inner ends of each of said passages and a second plurality of openings through a second one of said platforms at radially outer ends of each of said passages wherein inlets to said passages comprise one of said first and second pluralities of openings and outlets to said passages comprise another of said first and second pluralities of openings.

10. A vane as claimed in claim 6 further comprising tie elements disposed across said cavity between spaced apart portions of said inner shell of said outer wall along said pressure side and said suction side.

11. A vane as claimed in claim 6 wherein said inner shell and an outer shell are of unequal thicknesses.

12. A vane as claimed in claim 6 wherein at least one of said cooling passages further comprises:

an inlet and an outlet to said passage, a serpentine cooling path between said inlet and said outlet, said serpentine cooling path including a means to direct cooling air in radially inward and outward directions between said inlet and said outlet.

* * * * *